US006808368B1

(12) United States Patent
Tomberg et al.

(10) Patent No.: US 6,808,368 B1
(45) Date of Patent: Oct. 26, 2004

(54) AIRFOIL SHAPE FOR A TURBINE BUCKET

(75) Inventors: Steven Eric Tomberg, Simpsonville, SC (US); David Samuel Pesetsky, Greenville, SC (US)

(73) Assignee: General Electric Company, Schenectad, NY (US)

( * ) Notice: Subject to any disclaimer, the term of this patent is extended or adjusted under 35 U.S.C. 154(b) by 0 days.

(21) Appl. No.: 10/460,205

(22) Filed: Jun. 13, 2003

(51) Int. Cl.[7] ..... F01D 5/14
(52) U.S. Cl. ..... 416/223 A; 416/243; 416/DIG. 2
(58) Field of Search ..... 416/223 A, 223 R, 416/243, DIG. 2

(56) References Cited

U.S. PATENT DOCUMENTS 6,450,770 B1 * 9/2002 Wang et al. ..... 416/223 A
6,558,122 B1 * 5/2003 Xu et al. ..... 416/223 A
6,685,434 B1 * 2/2004 Humanchuk et al. ... 416/223 A
6,722,853 B1 * 4/2004 Humanchuk et al. ... 416/223 A

* cited by examiner

*Primary Examiner*—John J. Vrablik
(74) *Attorney, Agent, or Firm*—Nixon & Vanderhye

(57) ABSTRACT

Second stage turbine buckets have airfoil profiles substantially in accordance with Cartesian coordinate values of X, Y and Z set forth Table 1 wherein X and Y values are in inches and the Z values are non-dimensional values from 0.088 to 0.92 convertible to Z distances in inches by multiplying the Z values by the height of the airfoil in inches. The X and Y values are distances which, when connected by smooth continuing arcs, define airfoil profile sections at each distance Z. The profile sections at each distance Z are joined smoothly to one another to form a complete airfoil shape. The X and Y distances may be scalable as a function of the same constant or number to provide a scaled up or scaled down airfoil section for the bucket. The nominal airfoil given by the X, Y and Z distances lies within an envelop of ±0.160 inches in directions normal to the surface of the airfoil.

21 Claims, 5 Drawing Sheets

AIRFOIL SHAPE FOR A TURBINE BUCKET

BACKGROUND OF THE INVENTION

The present invention relates to an airfoil for a bucket of a stage of a gas turbine and particularly relates to a second stage turbine bucket airfoil profile.

Many system requirements must be met for each stage of the hot gas path section of a gas turbine in order to meet design goals including overall improved efficiency and airfoil loading. Particularly, the buckets of the second stage of the turbine section must meet the thermal and mechanical operating requirements for that particular stage.

BRIEF DESCRIPTION OF THE INVENTION

In accordance with the preferred embodiment of the present invention there is provided a unique airfoil shape for a bucket of a gas turbine, preferably the second stage bucket, that enhances the performance of the gas turbine. The airfoil shape hereof also improves the interaction between various stages of the turbine and affords improved aerodynamic efficiency while simultaneously reducing second stage airfoil thermal and mechanical stresses.

The bucket airfoil profile is defined by a unique loci of points to achieve the necessary efficiency and loading requirements whereby improved turbine performance is obtained. These unique loci of points define the nominal airfoil profile and are identified by the X, Y and Z Cartesian coordinates of Table 1 which follows The 1320 points for the coordinate values shown in Table 1 are relative to the turbine centerline and for a cold, i.e., room temperature bucket at various cross-sections of the bucket airfoil along its length. The positive X, Y and Z directions are axial toward the exhaust end of the turbine, tangential in the direction of engine rotation and radially outwardly toward the bucket tip, respectively. The X and Y coordinates are given in distance dimensions, e.g., units of inches, and are joined smoothly at each Z location to form a smooth continuous airfoil cross-section. The Z coordinates are given in non-dimensionalized form from 0.088 to 0.924 and therefore exclude fillet regions at the platform and tip shroud. By multiplying the airfoil height dimension, e.g., in inches, by the non-dimensional Z value of Table 1, the airfoil shape, i.e., the profile, of the bucket airfoil is obtained. Each defined airfoil section in the X, Y plane is joined smoothly with adjacent airfoil sections in the Z direction to form the complete airfoil shape.

It will be appreciated that as each bucket airfoil heats up in use, the profile will change as a result of mechanical loading and temperature. Thus, the cold or room temperature profile is given by the X, Y and Z coordinates for manufacturing purposes. Because a manufactured bucket airfoil profile may be different from the nominal airfoil profile given by the following table, a distance of plus or minus 0.160 inches from the nominal profile in a direction normal to any surface location along the nominal profile and which includes any coating, defines a profile envelope for this bucket airfoil. The airfoil shape is robust to this variation without impairment of the mechanical and aerodynamic functions of the bucket.

It will also be appreciated that the airfoil can be scaled up or scaled down geometrically for introduction into similar turbine designs. Consequently, the X and Y coordinates in inches of the nominal airfoil profile given below may be a function of the same constant or number. That is, the X and Y coordinate values in inches may be multiplied or divided by the same constant or number to provide a scaled up or scaled down version of the bucket airfoil profile while retaining the airfoil section shape.

In a preferred embodiment according to the present invention, there is provided a turbine bucket including a bucket airfoil having an airfoil shape, the airfoil having a nominal profile substantially in accordance with Cartesian coordinate values of X, Y and Z set forth in Table 1 wherein the Z values are non-dimensional values from 0.088 to 0.92 convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape.

In a further preferred embodiment according to the present invention, there is provided a turbine bucket including a bucket airfoil having an uncoated nominal airfoil profile substantially in accordance with Cartesian coordinate values of X, Y and Z set forth in Table 1 wherein the Z values are non-dimensional values from 0.088 to 0.92 convertible to Z distances in inches by multiplying the Z values by a height of the airfoil in inches, and wherein X and Y are distances in inches which, when connected by smooth continuing arcs, define airfoil profile sections at each Z distance, the profile sections at the Z distances being joined smoothly with one another to form a complete airfoil shape, the X and Y distances being scalable as a function of the same constant or number to provide a scaled-up or scaled-down airfoil.

In a further preferred embodiment according to the present invention, there is provided a turbine comprising a turbine wheel having a plurality of buckets, each of the buckets including an airfoil having an airfoil shape, the airfoil having a nominal profile substantially in accordance with Cartesian coordinate values of X, Y and Z set forth in Table 1 wherein the Z values are non-dimensional values from 0.088 to 0.92 convertible to Z distances in inches by multiplying the Z values by a height of the airfoil in inches, and wherein X and Y are distances in inches which, when connected by smooth continuing arcs, define the airfoil profile sections at each distance Z, the profile sections at the Z distances being joined smoothly with one another to form a complete airfoil shape.

In a further preferred embodiment according to the present invention, there is provided a turbine comprising a turbine wheel having a plurality of buckets, each of the buckets including an airfoil having an uncoated nominal airfoil profile substantially in accordance with Cartesian coordinate values of X, Y and Z set forth in Table 1 wherein the Z values are non-dimensional values from 0.88 to 0.92 convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape, the X and Y distances being scalable as a function of the same constant or number to provide a scaled-up or scaled-down bucket airfoil.

DETAILED DESCRIPTION OF THE INVENTION

Figure 1:
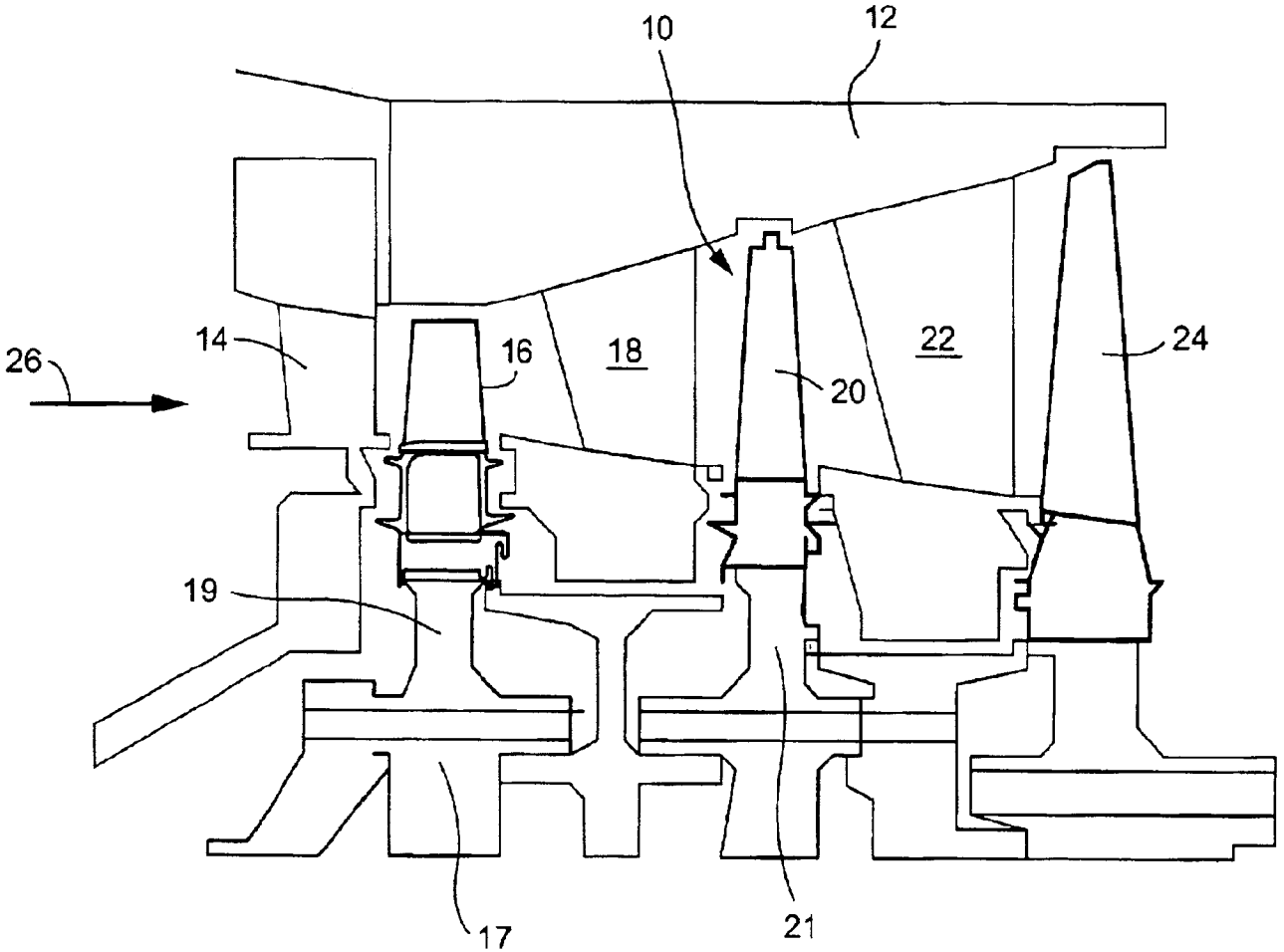
FIG. 1 is a schematic representation of a hot gas path through multiple stages of a gas turbine and illustrates a second stage bucket airfoil according to a preferred embodiment of the present invention.
Figure 2:
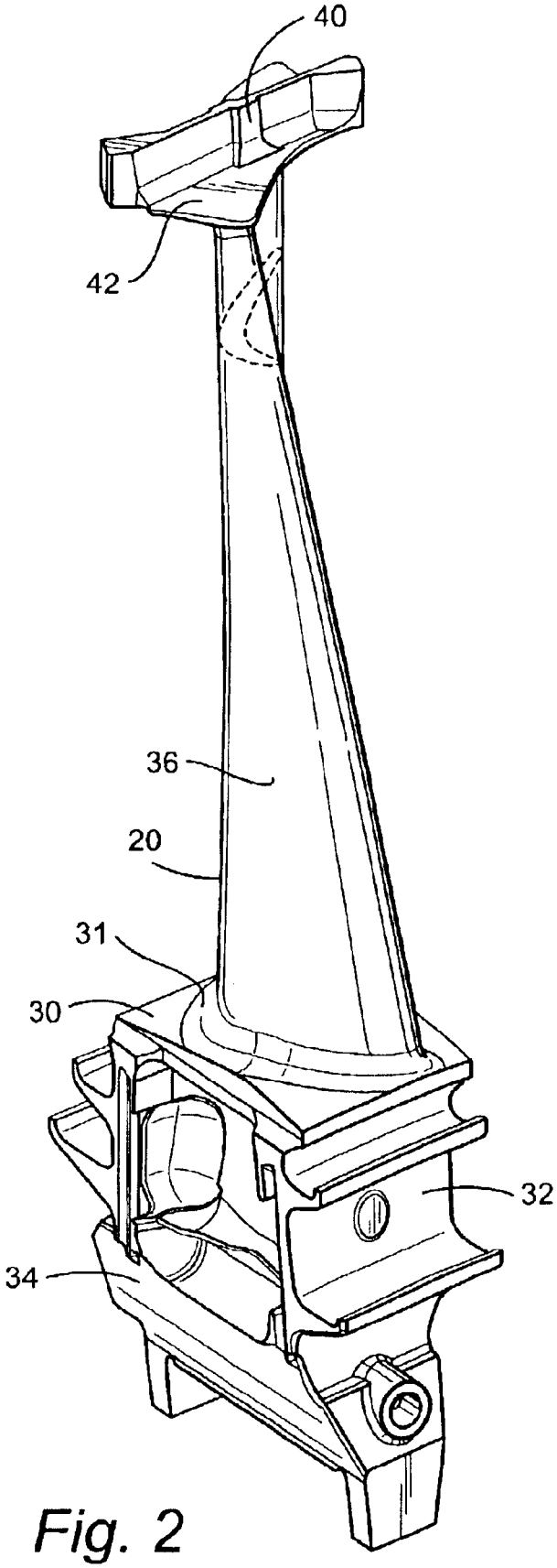
FIGS. 2 and 4 are respective perspective views of a bucket according to a preferred embodiment of the present invention with the bucket airfoil illustrated in conjunction with its platform and its substantially or near axial entry dovetail connection.
Figure 3:
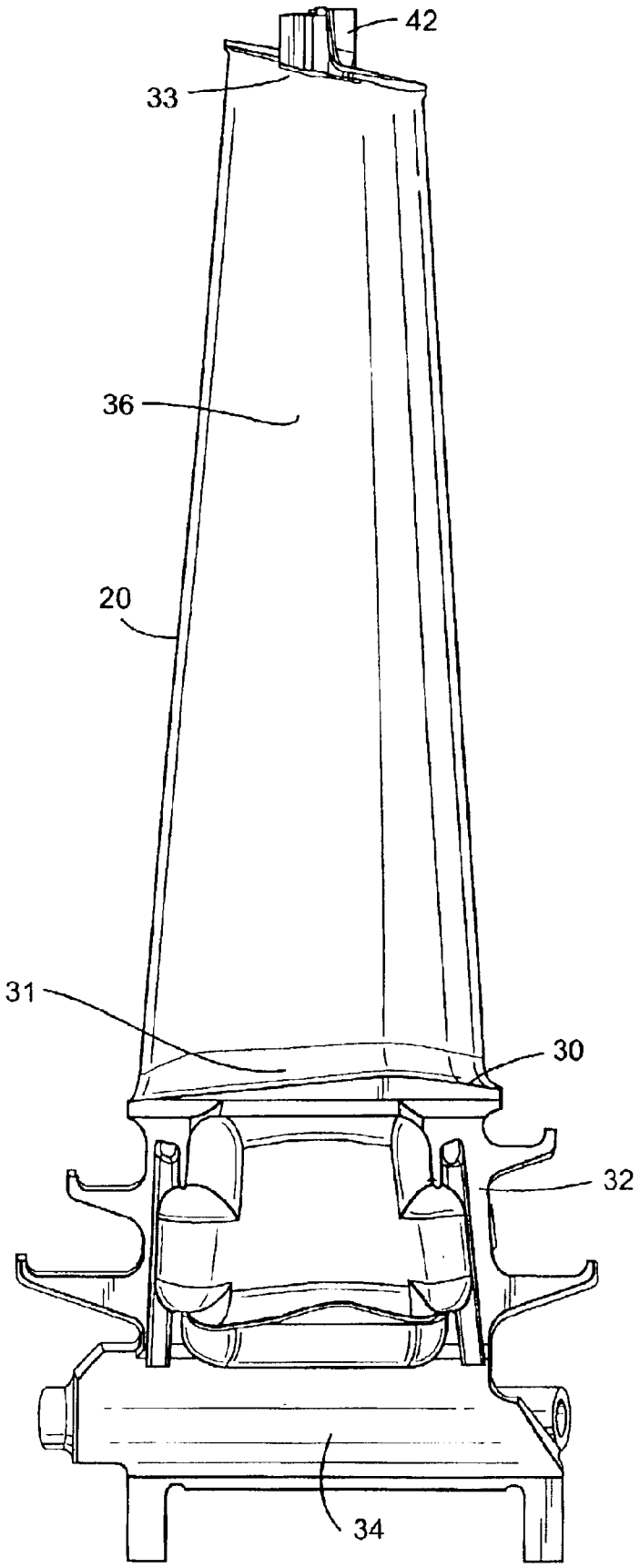
FIGS. 3 and 5 are side elevational views of the bucket of FIG. 2 and associated platform and dovetail connection as viewed in a generally circumferential direction from the suction and pressure sides of the airfoil, respectively.
Figure 4:
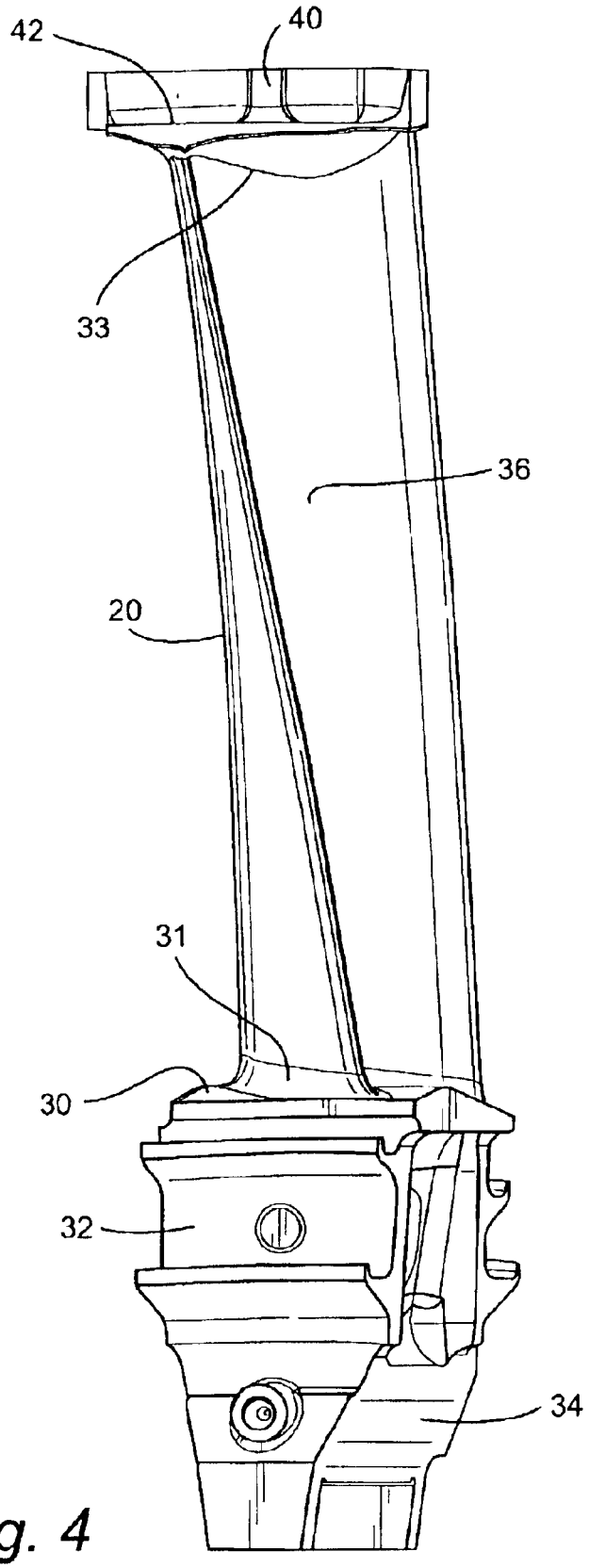

Referring now to the drawings, particularly to FIG. 1, there is illustrated a hot gas path, generally designated 10, of a gas turbine 12 including a plurality of turbine stages. Three stages are illustrated. For example, the first stage comprises a plurality of circumferentially spaced nozzles 14 and buckets 16. The nozzles are circumferentially spaced one from the other and fixed about the axis of the rotor. The first stage buckets 16, of course, are mounted on the turbine rotor 17 via a rotor wheel 19. A second stage of the turbine 12 is also illustrated, including a plurality of circumferentially spaced nozzles 18 and a plurality of circumferentially spaced buckets 20 mounted on the rotor 17. The third stage is also illustrated including a plurality of circumferentially spaced nozzles 22 and buckets 24 mounted on rotor 17. It will be appreciated that the nozzles and buckets lie in the hot gas path 10 of the turbine, the direction of flow of the hot gas through the hot gas path 10 being indicated by the arrow 26.

Figure 5:
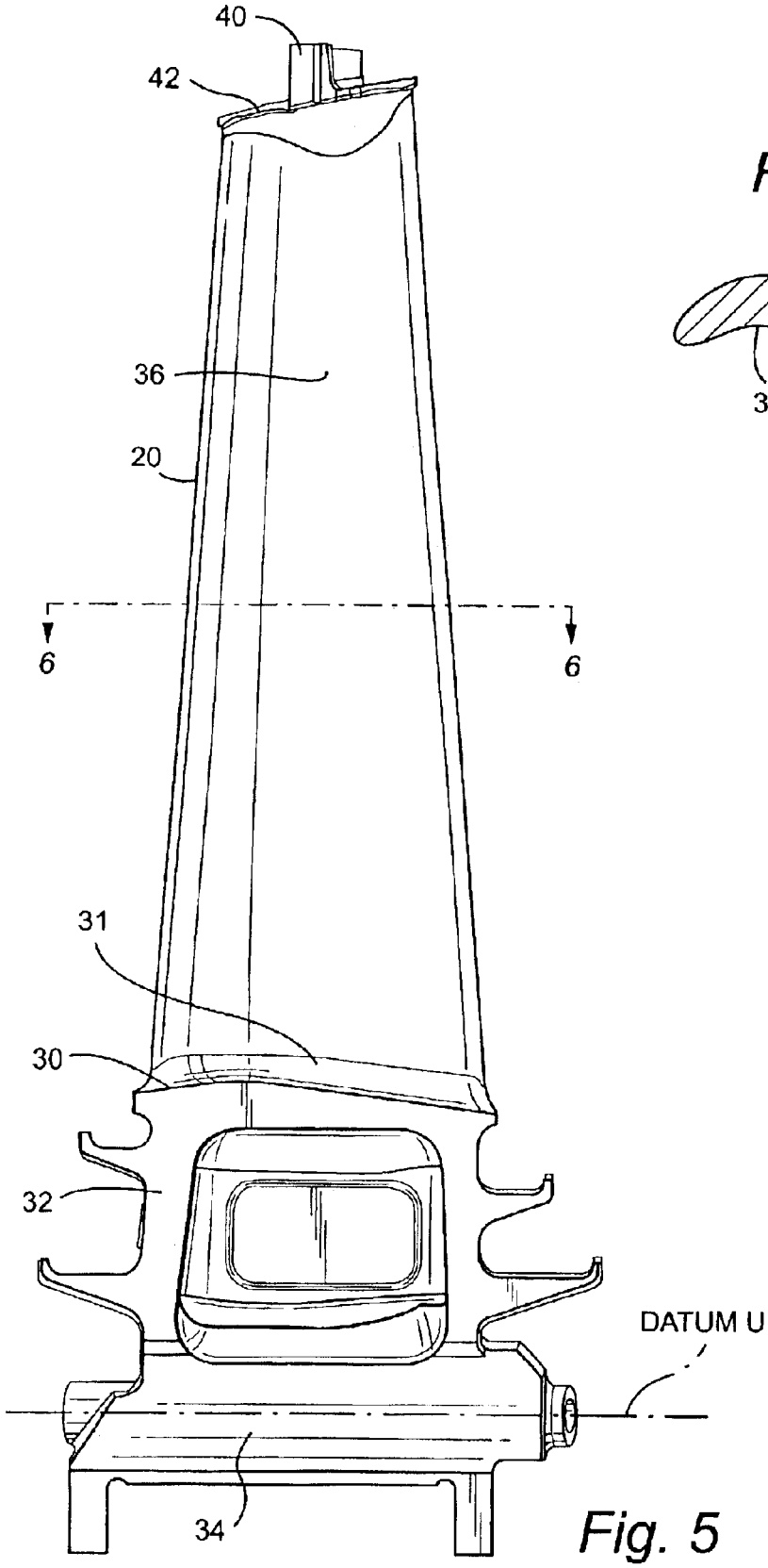
Figure 6:
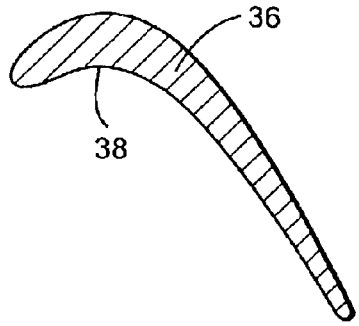
FIG. 6 is a cross-sectional view of the bucket airfoil taken generally about on line 6—6 in FIG. 5.

It will be appreciated that the buckets, for example, the buckets 20 of the second stage are mounted on a rotor wheel 21 forming part of rotor 17. Each bucket 20 is provided with a platform 30, a shank 32 and substantially or near axial entry dovetail 34 for connection with a complementary-shaped mating dovetail, not shown, on the rotor wheel 21. An axial entry dovetail, however, may be provided with the airfoil profile of this invention. It will also be appreciated that each bucket 20 has a bucket airfoil 36 as illustrated in FIGS. 2–6. Thus, each of the buckets 20 has a bucket airfoil profile 38 at any cross-section from the airfoil root 31 at a midpoint of platform 30 to the bucket tip 33 in the shape of an airfoil (FIG. 6).

To define the airfoil shape of each second stage bucket airfoil, there is a unique set or loci of points in space that meet the stage requirements and can be manufactured. This unique loci of points meets the requirements for stage efficiency and reduced thermal and mechanical stresses. The loci of points are arrived at by iteration between aerodynamic and mechanical loadings enabling the turbine to run in an efficient, safe and smooth manner. The loci which defines the bucket airfoil profile comprises a set of 1320 points relative to the axis of rotation of the turbine. A Cartesian coordinate system of X, Y and Z values given in Table 1 below define the profile of the bucket airfoil at various locations along its length. The coordinate values for the X and Y coordinates are set forth in inches in Table 1 although other units of dimensions may be used when the values are appropriately converted. The Z values are set forth in Table 1 in non-dimensional form from 0.088 to 0.92. These values exclude the fillet regions of the platform and the tip shroud. To convert the Z value to a Z coordinate value, e.g., in inches, the non-dimensional z value given in the table is multiplied by the height of airfoil in inches. The Cartesian coordinate system has orthogonally-related X, Y and Z axes and the X axis lies parallel to the turbine rotor centerline, i.e., the rotary axis and a positive X coordinate value is axial toward the aft, i.e., exhaust end of the turbine. The positive Y coordinate value looking aft extends tangentially in the direction of rotation of the rotor and the positive Z coordinate value is radially outwardly toward the bucket tip.

By defining X and Y coordinate values at selected locations in a Z direction normal to the X, Y plane, the profile section of the bucket airfoil, e.g., the profile section 38 illustrated in FIG. 6, at each Z distance along the length of the airfoil can be ascertained. By connecting the X and Y values with smooth continuing arcs, each profile section 38 at each distance Z is fixed. The airfoil profiles of the various surface locations between the distances Z are determined by smoothly connecting the adjacent profile sections 38 to one another to form the airfoil profile. These values represent the airfoil profiles at ambient, non-operating or non-hot conditions and are for an uncoated airfoil.

The Table 1 values are generated and shown to three decimal places for determining the profile of the airfoil. There are typical manufacturing tolerances as well as coatings which must be accounted for in the actual profile of the airfoil. Accordingly, the values for the profile given in Table 1 are for a nominal airfoil. It will therefore be appreciated that ±typical manufacturing tolerances, i.e., ±values, including any coating thicknesses, are additive to the X and Y values given in Table 1 below. Accordingly, a distance of ±0.160 inches in a direction normal to any surface location along the airfoil profile defines an airfoil profile envelope for this particular bucket airfoil design and turbine, i.e., a range of variation between measured points on the actual airfoil surface at nominal cold or room temperature and the ideal position of those points as given in the Table below at the same temperature. The bucket airfoil design is robust to this range of variation without impairment of mechanical and aerodynamic functions.

The coordinate values given in Table 1 below provide the preferred nominal profile envelope.

TABLE 1

| X | Y | Z' | X | Y | Z' | X | Y | Z' |
|---|---|---|---|---|---|---|---|---|
| −1.291 | −0.288 | 0.088 | 0.492 | 0.262 | 0.088 | 0.901 | −0.765 | 0.088 |
| −1.313 | −0.230 | 0.088 | 0.533 | 0.214 | 0.088 | 0.859 | −0.718 | 0.088 |
| −1.317 | −0.167 | 0.088 | 0.573 | 0.165 | 0.088 | 0.816 | −0.672 | 0.088 |
| −1.312 | −0.104 | 0.088 | 0.612 | 0.115 | 0.088 | 0.772 | −0.626 | 0.088 |
| −1.300 | −0.042 | 0.088 | 0.650 | 0.065 | 0.088 | 0.728 | −0.581 | 0.088 |
| −1.282 | 0.018 | 0.088 | 0.687 | 0.014 | 0.088 | 0.684 | −0.537 | 0.088 |
| −1.260 | 0.077 | 0.088 | 0.722 | −0.038 | 0.088 | 0.638 | −0.493 | 0.088 |
| −1.233 | 0.135 | 0.088 | 0.757 | −0.091 | 0.088 | 0.592 | −0.450 | 0.088 |
| −1.203 | 0.190 | 0.088 | 0.792 | −0.144 | 0.088 | 0.544 | −0.408 | 0.088 |
| −1.169 | 0.243 | 0.088 | 0.825 | −0.197 | 0.088 | 0.496 | −0.368 | 0.088 |
| −1.132 | 0.294 | 0.088 | 0.858 | −0.251 | 0.088 | 0.447 | −0.328 | 0.088 |

TABLE 1-continued

| X | Y | Z' | X | Y | Z' | X | Y | Z' |
|---|---|---|---|---|---|---|---|---|
| −1.092 | 0.343 | 0.088 | 0.890 | −0.306 | 0.088 | 0.397 | −0.290 | 0.088 |
| −1.050 | 0.390 | 0.088 | 0.922 | −0.360 | 0.088 | 0.346 | −0.253 | 0.088 |
| −1.004 | 0.434 | 0.088 | 0.953 | −0.415 | 0.088 | 0.293 | −0.218 | 0.088 |
| −0.957 | 0.475 | 0.088 | 0.984 | −0.470 | 0.088 | 0.240 | −0.185 | 0.088 |
| −0.907 | 0.513 | 0.088 | 1.014 | −0.525 | 0.088 | 0.185 | −0.153 | 0.088 |
| −0.854 | 0.549 | 0.088 | 1.045 | −0.581 | 0.088 | 0.129 | −0.124 | 0.088 |
| −0.800 | 0.581 | 0.088 | 1.075 | −0.636 | 0.088 | 0.072 | −0.097 | 0.088 |
| −0.744 | 0.610 | 0.088 | 1.105 | −0.692 | 0.088 | 0.014 | −0.073 | 0.088 |
| −0.686 | 0.635 | 0.088 | 1.135 | −0.747 | 0.088 | −0.046 | −0.051 | 0.088 |
| −0.627 | 0.657 | 0.088 | 1.164 | −0.803 | 0.088 | −0.106 | −0.033 | 0.088 |
| −0.566 | 0.675 | 0.088 | 1.194 | −0.859 | 0.088 | −0.167 | −0.018 | 0.088 |
| −0.505 | 0.688 | 0.088 | 1.224 | −0.914 | 0.088 | −0.230 | −0.007 | 0.088 |
| −0.442 | 0.698 | 0.088 | 1.253 | −0.970 | 0.088 | −0.292 | 0.001 | 0.088 |
| −0.380 | 0.702 | 0.088 | 1.282 | −1.026 | 0.088 | −0.355 | 0.005 | 0.088 |
| −0.317 | 0.703 | 0.088 | 1.312 | −1.082 | 0.088 | −0.418 | 0.006 | 0.088 |
| −0.254 | 0.698 | 0.088 | 1.341 | −1.138 | 0.088 | −0.481 | 0.003 | 0.088 |
| −0.191 | 0.689 | 0.088 | 1.371 | −1.193 | 0.088 | −0.544 | −0.004 | 0.088 |
| −0.130 | 0.675 | 0.088 | 1.394 | −1.251 | 0.088 | −0.606 | −0.015 | 0.088 |
| −0.069 | 0.657 | 0.088 | 1.353 | −1.289 | 0.088 | −0.668 | −0.029 | 0.088 |
| −0.010 | 0.635 | 0.088 | 1.306 | −1.249 | 0.088 | −0.728 | −0.047 | 0.088 |
| 0.048 | 0.610 | 0.088 | 1.267 | −1.199 | 0.088 | −0.788 | −0.068 | 0.088 |
| 0.104 | 0.581 | 0.088 | 1.227 | −1.151 | 0.086 | −0.846 | −0.092 | 0.088 |
| 0.159 | 0.549 | 0.088 | 1.187 | −1.102 | 0.088 | −0.903 | −0.119 | 0.088 |
| 0.211 | 0.515 | 0.088 | 1.147 | −1.053 | 0.088 | −0.959 | −0.148 | 0.088 |
| 0.262 | 0.478 | 0.088 | 1.107 | −1.004 | 0.088 | −1.013 | −0.180 | 0.088 |
| 0.312 | 0.438 | 0.088 | 1.066 | −0.956 | 0.088 | −1.067 | −0.214 | 0.088 |
| 0.359 | 0.397 | 0.088 | 1.026 | −0.908 | 0.088 | −1.120 | −0.248 | 0.088 |
| 0.405 | 0.353 | 0.088 | 0.985 | −0.860 | 0.088 | −1.174 | −0.281 | 0.088 |
| 0.449 | 0.308 | 0.088 | 0.943 | −0.812 | 0.088 | −1.232 | −0.303 | 0.088 |
| −1.252 | 0.091 | 0.10 | −0.173 | 0.686 | 0.10 | 1.022 | −0.550 | 0.10 |
| −1.218 | −0.282 | 0.10 | −0.089 | −0.026 | 0.10 | 0.910 | −0.777 | 0.10 |
| −1.305 | −0.217 | 0.10 | −0.488 | 0.693 | 0.10 | 0.731 | −0.060 | 0.10 |
| −1.274 | 0.032 | 0.10 | −0.299 | 0.703 | 0.10 | 1.194 | −1.116 | 0.10 |
| −1.194 | 0.203 | 0.10 | −0.028 | −0.046 | 0.10 | 0.952 | −0.824 | 0.10 |
| −1.106 | −0.225 | 0.10 | −0.464 | 0.019 | 0.10 | 0.783 | −0.636 | 0.10 |
| −1.309 | −0.154 | 0.10 | −0.337 | 0.019 | 0.10 | 1.142 | −0.773 | 0.10 |
| −1.159 | 0.257 | 0.10 | −0.112 | 0.670 | 0.10 | 1.201 | −0.884 | 0.10 |
| −1.279 | −0.273 | 0.10 | 0.031 | −0.068 | 0.10 | 0.649 | −0.501 | 0.10 |
| −1.305 | −0.091 | 0.10 | −0.274 | 0.013 | 0.10 | 0.993 | −0.872 | 0.10 |
| −1.122 | 0.308 | 0.10 | −0.425 | 0.701 | 0.10 | 1.172 | −0.829 | 0.10 |
| −1.292 | −0.029 | 0.10 | −0.236 | 0.697 | 0.10 | 0.866 | −0.275 | 0.10 |
| −1.160 | −0.258 | 0.10 | −0.400 | 0.021 | 0.10 | 1.115 | −1.018 | 0.10 |
| −1.225 | 0.148 | 0.10 | 0.372 | 0.380 | 0.10 | 0.800 | −0.167 | 0.10 |
| −0.589 | 0.004 | 0.10 | 0.411 | −0.294 | 0.10 | 1.112 | −0.717 | 0.10 |
| −0.841 | 0.560 | 0.10 | 0.255 | −0.185 | 0.10 | 1.052 | −0.606 | 0.10 |
| −0.772 | −0.047 | 0.10 | 0.557 | −0.415 | 0.10 | 0.868 | −0.729 | 0.10 |
| −0.944 | −0.126 | 0.10 | 0.089 | −0.094 | 0.10 | 0.898 | −0.329 | 0.10 |
| −0.611 | 0.664 | 0.10 | 0.583 | 0.145 | 0.10 | 0.696 | −0.008 | 0.10 |
| −1.082 | 0.356 | 0.10 | 0.325 | 0.423 | 0.10 | 0.833 | −0.221 | 0.10 |
| −0.999 | −0.157 | 0.10 | 0.509 | −0.373 | 0.10 | 1.155 | −1.067 | 0.10 |
| −0.944 | 0.487 | 0.10 | 0.461 | 0.290 | 0.10 | 1.075 | −0.969 | 0.10 |
| −0.712 | −0.026 | 0.10 | 0.360 | −0.256 | 0.10 | 0.659 | 0.044 | 0.10 |
| −1.038 | 0.402 | 0.10 | 0.277 | 0.463 | 0.10 | 0.991 | −0.495 | 0.10 |
| −0.786 | 0.591 | 0.10 | 0.603 | −0.458 | 0.10 | 0.766 | −0.113 | 0.10 |
| −0.651 | −0.009 | 0.10 | 0.201 | −0.153 | 0.10 | 0.826 | −0.683 | 0.10 |
| −0.671 | 0.644 | 0.10 | 0.503 | 0.243 | 0.10 | 0.694 | −0.545 | 0.10 |
| −0.831 | −0.070 | 0.10 | 0.064 | 0.600 | 0.10 | 0.960 | −0.439 | 0.10 |
| −0.550 | 0.681 | 0.10 | 0.226 | 0.501 | 0.10 | 0.739 | −0.591 | 0.10 |
| −0.992 | 0.446 | 0.10 | 0.174 | 0.537 | 0.10 | 1.349 | −1.164 | 0.10 |
| −0.527 | 0.014 | 0.10 | 0.460 | −0.333 | 0.10 | 1.369 | −1.277 | 0.10 |
| −0.894 | 0.525 | 0.10 | 0.622 | 0.095 | 0.10 | 1.234 | −1.165 | 0.10 |
| −0.729 | 0.619 | 0.10 | 0.417 | 0.336 | 0.10 | 1.261 | −0.996 | 0.10 |
| −1.053 | −0.190 | 0.10 | 0.145 | −0.122 | 0.10 | 1.379 | −1.220 | 0.10 |
| −0.888 | −0.096 | 0.10 | 0.120 | 0.570 | 0.10 | 1.313 | −1.264 | 0.10 |
| −0.052 | 0.651 | 0.10 | 0.308 | −0.220 | 0.10 | 1.369 | −1.277 | 0.10 |
| −0.362 | 0.704 | 0.10 | 0.544 | 0.194 | 0.10 | 1.231 | −0.940 | 0.10 |
| −0.150 | −0.009 | 0.10 | 1.082 | −0.661 | 0.10 | 1.319 | −1.108 | 0.10 |
| −0.212 | 0.004 | 0.10 | 0.929 | −0.384 | 0.10 | 1.274 | −1.214 | 0.10 |
| 0.007 | 0.627 | 0.10 | 1.034 | −0.921 | 0.10 | 1.290 | −1.052 | 0.10 |
| −1.170 | 0.232 | 0.20 | −0.258 | 0.126 | 0.20 | 0.794 | −0.651 | 0.20 |
| −1.139 | 0.284 | 0.20 | −0.378 | 0.143 | 0.20 | 1.167 | −0.912 | 0.20 |
| −1.246 | 0.004 | 0.20 | −0.446 | 0.717 | 0.20 | 1.204 | −1.175 | 0.20 |
| −1.236 | 0.063 | 0.20 | −0.199 | 0.112 | 0.20 | 0.690 | −0.070 | 0.20 |
| −1.219 | 0.122 | 0.20 | −0.084 | 0.074 | 0.20 | 1.195 | −0.966 | 0.20 |
| −1.196 | 0.178 | 0.20 | −0.317 | 0.136 | 0.20 | 0.833 | −0.697 | 0.20 |
| −1.165 | −0.125 | 0.20 | −0.265 | 0.711 | 0.20 | 0.909 | −0.791 | 0.20 |
| −1.222 | −0.111 | 0.20 | 0.021 | 0.616 | 0.20 | 0.755 | −0.604 | 0.20 |

TABLE 1-continued

| X | Y | Z' | X | Y | Z' | X | Y | Z' |
|---|---|---|---|---|---|---|---|---|
| −1.246 | −0.057 | 0.20 | −0.498 | 0.143 | 0.20 | 0.908 | −0.433 | 0.20 |
| −1.107 | −0.108 | 0.20 | −0.147 | 0.685 | 0.20 | 1.020 | −0.935 | 0.20 |
| −0.941 | 0.511 | 0.20 | −0.205 | 0.701 | 0.20 | 0.755 | −0.172 | 0.20 |
| −0.791 | 0.070 | 0.20 | −0.385 | 0.720 | 0.20 | 0.967 | −0.539 | 0.20 |
| −1.003 | −0.045 | 0.20 | 0.398 | 0.316 | 0.20 | 0.848 | −0.328 | 0.20 |
| −0.737 | 0.641 | 0.20 | 0.466 | −0.295 | 0.20 | 1.110 | −0.806 | 0.20 |
| −0.618 | 0.126 | 0.20 | 0.552 | −0.380 | 0.20 | 0.657 | −0.020 | 0.20 |
| −0.681 | 0.665 | 0.20 | 0.268 | 0.443 | 0.20 | 1.130 | −1.079 | 0.20 |
| −0.846 | 0.045 | 0.20 | 0.594 | −0.423 | 0.20 | 1.167 | −1.127 | 0.20 |
| −0.565 | 0.699 | 0.20 | 0.622 | 0.031 | 0.20 | 0.716 | −0.558 | 0.20 |
| −0.791 | 0.614 | 0.20 | 0.183 | −0.067 | 0.20 | 0.996 | −0.592 | 0.20 |
| −1.105 | 0.335 | 0.20 | 0.233 | −0.102 | 0.20 | 0.938 | −0.486 | 0.20 |
| −0.843 | 0.583 | 0.20 | 0.438 | 0.270 | 0.20 | 0.871 | −0.744 | 0.20 |
| −1.068 | 0.382 | 0.20 | 0.329 | −0.175 | 0.20 | 0.946 | −0.839 | 0.20 |
| −0.559 | 0.137 | 0.20 | 0.282 | −0.138 | 0.20 | 0.676 | −0.513 | 0.20 |
| −0.899 | 0.017 | 0.20 | 0.074 | 0.586 | 0.20 | 1.057 | −0.983 | 0.20 |
| −0.893 | 0.548 | 0.20 | 0.477 | 0.224 | 0.20 | 1.223 | −1.020 | 0.20 |
| −1.028 | 0.428 | 0.20 | 0.222 | 0.482 | 0.20 | 0.818 | −0.276 | 0.20 |
| −0.952 | −0.013 | 0.20 | 0.080 | −0.004 | 0.20 | 1.025 | −0.645 | 0.20 |
| −0.624 | 0.684 | 0.20 | 0.125 | 0.554 | 0.20 | 1.139 | −0.859 | 0.20 |
| −1.055 | −0.077 | 0.20 | 0.515 | 0.177 | 0.20 | 0.723 | −0.121 | 0.20 |
| −0.986 | 0.471 | 0.20 | 0.376 | −0.214 | 0.20 | 1.082 | −0.752 | 0.20 |
| −0.734 | 0.092 | 0.20 | 0.635 | −0.468 | 0.20 | 0.787 | −0.224 | 0.20 |
| −0.677 | 0.111 | 0.20 | 0.552 | 0.129 | 0.20 | 1.053 | −0.699 | 0.20 |
| −0.325 | 0.718 | 0.20 | 0.174 | 0.519 | 0.20 | 0.983 | −0.887 | 0.20 |
| −0.141 | 0.095 | 0.20 | 0.313 | 0.402 | 0.20 | 0.878 | −0.381 | 0.20 |
| −0.506 | 0.710 | 0.20 | 0.132 | −0.035 | 0.20 | 1.294 | −1.234 | 0.20 |
| 0.027 | 0.025 | 0.20 | 0.356 | 0.359 | 0.20 | 1.251 | −1.074 | 0.20 |
| −0.089 | 0.666 | 0.20 | 0.509 | −0.337 | 0.20 | 1.307 | −1.181 | 0.20 |
| −0.033 | 0.643 | 0.20 | 0.421 | −0.254 | 0.20 | 1.240 | −1.224 | 0.20 |
| −0.438 | 0.145 | 0.20 | 0.588 | 0.080 | 0.20 | 1.294 | −1.234 | 0.20 |
| −0.028 | 0.051 | 0.20 | 1.094 | −1.031 | 0.20 | 1.279 | −1.127 | 0.20 |
| −1.113 | 0.033 | 0.30 | −0.406 | 0.750 | 0.30 | 0.931 | −0.851 | 0.30 |
| −1.144 | 0.272 | 0.30 | −0.468 | 0.270 | 0.30 | 0.688 | −0.526 | 0.30 |
| −1.182 | 0.163 | 0.30 | −0.078 | 0.172 | 0.30 | 1.210 | −1.087 | 0.30 |
| −1.187 | 0.105 | 0.30 | −0.070 | 0.669 | 0.30 | 1.033 | −0.992 | 0.30 |
| −1.118 | 0.324 | 0.30 | −0.295 | 0.251 | 0.30 | 1.077 | −0.829 | 0.30 |
| −1.166 | 0.219 | 0.30 | −0.234 | 0.728 | 0.30 | 0.897 | −0.804 | 0.30 |
| −1.166 | 0.053 | 0.30 | −0.130 | 0.197 | 0.30 | 1.134 | −1.133 | 0.30 |
| −1.054 | 0.421 | 0.30 | −0.239 | 0.236 | 0.30 | 0.652 | −0.480 | 0.30 |
| −0.793 | 0.648 | 0.30 | 0.031 | 0.612 | 0.30 | 0.759 | −0.617 | 0.30 |
| −1.017 | 0.465 | 0.30 | −0.410 | 0.268 | 0.30 | 0.999 | −0.945 | 0.30 |
| −0.803 | 0.185 | 0.30 | −0.184 | 0.218 | 0.30 | 0.648 | −0.072 | 0.30 |
| −1.005 | 0.071 | 0.30 | 0.300 | −0.095 | 0.30 | 1.168 | −1.180 | 0.30 |
| −0.695 | 0.229 | 0.30 | 0.126 | 0.545 | 0.30 | 0.968 | −0.624 | 0.30 |
| −0.742 | 0.676 | 0.30 | 0.584 | 0.025 | 0.30 | 1.157 | −0.984 | 0.30 |
| −0.977 | 0.507 | 0.30 | 0.337 | 0.346 | 0.30 | 0.679 | −0.121 | 0.30 |
| −0.854 | 0.158 | 0.30 | 0.464 | −0.259 | 0.30 | 0.884 | −0.472 | 0.30 |
| −0.526 | 0.267 | 0.30 | 0.424 | −0.217 | 0.30 | 1.184 | −1.035 | 0.30 |
| −0.583 | 0.259 | 0.30 | 0.616 | −0.435 | 0.30 | 0.798 | −0.320 | 0.30 |
| −0.689 | 0.699 | 0.30 | 0.551 | 0.073 | 0.30 | 0.828 | −0.710 | 0.30 |
| −0.935 | 0.547 | 0.30 | 0.616 | −0.024 | 0.30 | 1.221 | −1.189 | 0.30 |
| −0.904 | 0.129 | 0.30 | 0.375 | 0.303 | 0.30 | 0.965 | −0.898 | 0.30 |
| −0.640 | 0.246 | 0.30 | 0.079 | 0.580 | 0.30 | 1.104 | −0.881 | 0.30 |
| −0.635 | 0.719 | 0.30 | 0.171 | 0.509 | 0.30 | 0.995 | −0.675 | 0.30 |
| −0.843 | 0.618 | 0.30 | 0.383 | −0.176 | 0.30 | 0.709 | −0.171 | 0.30 |
| −0.890 | 0.584 | 0.30 | 0.256 | −0.057 | 0.30 | 0.863 | −0.757 | 0.30 |
| −1.057 | 0.045 | 0.30 | 0.579 | −0.390 | 0.30 | 0.794 | −0.664 | 0.30 |
| −0.954 | 0.100 | 0.30 | 0.518 | 0.120 | 0.30 | 0.940 | −0.573 | 0.30 |
| −1.088 | 0.373 | 0.30 | 0.483 | 0.167 | 0.30 | 1.022 | −0.727 | 0.30 |
| −0.750 | 0.209 | 0.30 | 0.412 | 0.258 | 0.30 | 0.739 | −0.220 | 0.30 |
| −0.578 | 0.733 | 0.30 | 0.448 | 0.213 | 0.30 | 1.130 | −0.932 | 0.30 |
| −0.290 | 0.739 | 0.30 | 0.503 | −0.302 | 0.30 | 0.827 | −0.371 | 0.30 |
| 0.024 | 0.116 | 0.30 | 0.297 | 0.389 | 0.30 | 1.100 | −1.086 | 0.30 |
| −0.464 | 0.749 | 0.30 | 0.215 | 0.470 | 0.30 | 1.066 | −1.039 | 0.30 |
| −0.019 | 0.642 | 0.30 | 0.120 | 0.052 | 0.30 | 0.856 | −0.421 | 0.30 |
| −0.352 | 0.262 | 0.30 | 0.342 | −0.135 | 0.30 | 1.050 | −0.778 | 0.30 |
| −0.026 | 0.146 | 0.30 | 0.212 | −0.019 | 0.30 | 0.724 | −0.571 | 0.30 |
| −0.123 | 0.692 | 0.30 | 0.541 | −0.346 | 0.30 | 1.221 | −1.189 | 0.30 |
| −0.348 | 0.747 | 0.30 | 0.167 | 0.017 | 0.30 | 0.769 | −0.270 | 0.30 |
| −0.521 | 0.744 | 0.30 | 0.257 | 0.430 | 0.30 | 0.912 | −0.522 | 0.30 |
| −0.178 | 0.712 | 0.30 | 0.073 | 0.085 | 0.30 | 1.237 | −1.138 | 0.30 |
| −1.118 | 0.333 | 0.40 | −0.332 | 0.374 | 0.40 | 0.279 | 0.385 | 0.40 |
| −1.116 | 0.226 | 0.40 | −0.278 | 0.359 | 0.40 | 0.449 | 0.166 | 0.40 |
| −1.130 | 0.279 | 0.40 | −0.497 | 0.391 | 0.40 | 0.603 | −0.066 | 0.40 |
| −0.742 | 0.725 | 0.40 | −0.203 | 0.751 | 0.40 | 0.881 | −0.547 | 0.40 |
| −0.607 | 0.378 | 0.40 | −0.310 | 0.781 | 0.40 | 1.011 | −0.792 | 0.40 |

TABLE 1-continued

| X | Y | Z' | X | Y | Z' | X | Y | Z' |
|---|---|---|---|---|---|---|---|---|
| −1.070 | 0.433 | 0.40 | −0.226 | 0.340 | 0.40 | 0.967 | −0.948 | 0.40 |
| −0.913 | 0.248 | 0.40 | 0.016 | 0.204 | 0.40 | 1.138 | −1.039 | 0.40 |
| −0.966 | 0.563 | 0.40 | −0.053 | 0.679 | 0.40 | 0.651 | −0.490 | 0.40 |
| −0.883 | 0.637 | 0.40 | −0.386 | 0.384 | 0.40 | 0.905 | −0.856 | 0.40 |
| −0.531 | 0.791 | 0.40 | −0.152 | 0.730 | 0.40 | 0.717 | −0.256 | 0.40 |
| −0.838 | 0.670 | 0.40 | −0.175 | 0.318 | 0.40 | 0.986 | −0.743 | 0.40 |
| −0.692 | 0.748 | 0.40 | 0.226 | 0.023 | 0.40 | 0.999 | −0.993 | 0.40 |
| −0.661 | 0.364 | 0.40 | 0.484 | −0.268 | 0.40 | 1.113 | −0.990 | 0.40 |
| −0.064 | 0.275 | 0.40 | 0.304 | −0.057 | 0.40 | 0.874 | −0.810 | 0.40 |
| −0.586 | 0.761 | 0.40 | 0.103 | 0.135 | 0.40 | 0.684 | −0.536 | 0.40 |
| −1.039 | 0.479 | 0.40 | 0.242 | 0.427 | 0.40 | 0.654 | −0.498 | 0.40 |
| −0.815 | 0.300 | 0.40 | 0.417 | 0.211 | 0.40 | 0.689 | −0.208 | 0.40 |
| −1.070 | 0.198 | 0.40 | 0.573 | −0.019 | 0.40 | 0.960 | −0.694 | 0.40 |
| −0.639 | 0.767 | 0.40 | 0.519 | −0.312 | 0.40 | 1.030 | −1.039 | 0.40 |
| −1.097 | 0.384 | 0.40 | 0.341 | −0.098 | 0.40 | 0.716 | −0.581 | 0.40 |
| −0.552 | 0.387 | 0.40 | 0.204 | 0.467 | 0.40 | 0.827 | −0.449 | 0.40 |
| −0.765 | 0.324 | 0.40 | 0.383 | 0.256 | 0.40 | 1.088 | −0.940 | 0.40 |
| −1.015 | 0.203 | 0.40 | 0.543 | 0.026 | 0.40 | 0.661 | −0.161 | 0.40 |
| −0.791 | 0.699 | 0.40 | 0.186 | 0.061 | 0.40 | 0.800 | −0.401 | 0.40 |
| −0.714 | 0.346 | 0.40 | 0.165 | 0.507 | 0.40 | 0.934 | −0.645 | 0.40 |
| −1.004 | 0.522 | 0.40 | 0.552 | −0.356 | 0.40 | 1.062 | −1.085 | 0.40 |
| −0.926 | 0.601 | 0.40 | 0.349 | 0.299 | 0.40 | 1.145 | −1.138 | 0.40 |
| −0.963 | 0.224 | 0.40 | 0.512 | 0.074 | 0.40 | 0.748 | −0.626 | 0.40 |
| −0.441 | 0.390 | 0.40 | 0.378 | −0.140 | 0.40 | 1.094 | −1.130 | 0.40 |
| −0.476 | 0.796 | 0.40 | 0.586 | −0.401 | 0.40 | 0.773 | −0.353 | 0.40 |
| 0.039 | 0.616 | 0.40 | 0.414 | −0.182 | 0.40 | 0.907 | −0.596 | 0.40 |
| −0.125 | 0.293 | 0.40 | 0.124 | 0.545 | 0.40 | 1.063 | −0.891 | 0.40 |
| −0.420 | 0.796 | 0.40 | 0.314 | 0.343 | 0.40 | 1.037 | −0.842 | 0.40 |
| −0.030 | 0.235 | 0.40 | 0.481 | 0.120 | 0.40 | 0.936 | −0.902 | 0.40 |
| −0.256 | 0.768 | 0.40 | 0.145 | 0.099 | 0.40 | 1.163 | −1.089 | 0.40 |
| 0.060 | 0.170 | 0.40 | 0.632 | −0.113 | 0.40 | 0.779 | −0.672 | 0.40 |
| −0.102 | 0.706 | 0.40 | 0.619 | −0.445 | 0.40 | 1.145 | −1.138 | 0.40 |
| −0.006 | 0.649 | 0.40 | 0.265 | −0.017 | 0.40 | 0.811 | −0.718 | 0.40 |
| −0.365 | 0.791 | 0.40 | 0.082 | 0.582 | 0.40 | 0.842 | −0.764 | 0.40 |
| −0.077 | 0.265 | 0.40 | 0.450 | −0.225 | 0.40 | 0.745 | −0.304 | 0.40 |
| −0.783 | 0.446 | 0.50 | −0.368 | 0.494 | 0.50 | 0.326 | −0.061 | 0.50 |
| −0.992 | 0.603 | 0.50 | −0.429 | 0.853 | 0.50 | 0.153 | 0.141 | 0.50 |
| −0.786 | 0.769 | 0.50 | −0.175 | 0.780 | 0.50 | 0.352 | 0.263 | 0.50 |
| −0.734 | 0.466 | 0.50 | −0.083 | 0.726 | 0.50 | 0.154 | 0.514 | 0.50 |
| −0.535 | 0.851 | 0.50 | −0.084 | 0.354 | 0.50 | 0.289 | 0.349 | 0.50 |
| −0.981 | 0.371 | 0.50 | −0.317 | 0.479 | 0.50 | 0.637 | −0.186 | 0.50 |
| −1.025 | 0.561 | 0.50 | −0.482 | 0.855 | 0.50 | 0.499 | 0.041 | 0.50 |
| −0.832 | 0.742 | 0.50 | −0.041 | 0.322 | 0.50 | 0.956 | −0.984 | 0.50 |
| −0.587 | 0.842 | 0.50 | −0.267 | 0.460 | 0.50 | 1.015 | −0.889 | 0.50 |
| −0.683 | 0.483 | 0.50 | 0.042 | 0.627 | 0.50 | 0.810 | −0.761 | 0.50 |
| −0.579 | 0.506 | 0.50 | 0.118 | 0.553 | 0.50 | 0.767 | −0.418 | 0.50 |
| −0.930 | 0.384 | 0.50 | 0.359 | −0.103 | 0.50 | 1.065 | −1.077 | 0.50 |
| −1.052 | 0.515 | 0.50 | 0.189 | 0.101 | 0.50 | 0.665 | −0.539 | 0.50 |
| −0.876 | 0.711 | 0.50 | 0.470 | 0.086 | 0.50 | 0.818 | −0.511 | 0.50 |
| −0.639 | 0.830 | 0.50 | 0.321 | 0.306 | 0.50 | 0.843 | −0.558 | 0.50 |
| −0.880 | 0.404 | 0.50 | 0.610 | −0.140 | 0.50 | 0.742 | −0.371 | 0.50 |
| −1.072 | 0.466 | 0.50 | 0.555 | −0.049 | 0.50 | 0.868 | −0.605 | 0.50 |
| −0.917 | 0.678 | 0.50 | 0.441 | 0.131 | 0.50 | 0.985 | −1.028 | 0.50 |
| −0.690 | 0.813 | 0.50 | 0.412 | 0.175 | 0.50 | 0.991 | −0.841 | 0.50 |
| −0.832 | 0.425 | 0.50 | 0.391 | −0.146 | 0.50 | 0.839 | −0.806 | 0.50 |
| −1.071 | 0.414 | 0.50 | 0.224 | 0.062 | 0.50 | 0.694 | −0.583 | 0.50 |
| −0.739 | 0.793 | 0.50 | 0.582 | −0.095 | 0.50 | 0.716 | −0.325 | 0.50 |
| −0.632 | 0.497 | 0.50 | 0.293 | −0.020 | 0.50 | 1.016 | −1.071 | 0.50 |
| −0.956 | 0.642 | 0.50 | 0.576 | −0.406 | 0.50 | 0.967 | −0.794 | 0.50 |
| −0.526 | 0.511 | 0.50 | 0.423 | −0.188 | 0.50 | 0.781 | −0.717 | 0.50 |
| −1.034 | 0.377 | 0.50 | 0.259 | 0.021 | 0.50 | 0.868 | −0.851 | 0.50 |
| −0.128 | 0.754 | 0.50 | 0.079 | 0.216 | 0.50 | 0.723 | −0.628 | 0.50 |
| −0.273 | 0.821 | 0.50 | 0.257 | 0.391 | 0.50 | 0.690 | −0.279 | 0.50 |
| 0.002 | 0.662 | 0.50 | 0.606 | −0.450 | 0.50 | 1.065 | −1.077 | 0.50 |
| 0.000 | 0.288 | 0.50 | 0.455 | −0.231 | 0.50 | 0.943 | −0.746 | 0.50 |
| −0.219 | 0.438 | 0.50 | 0.116 | 0.179 | 0.50 | 0.898 | −0.895 | 0.50 |
| −0.473 | 0.510 | 0.50 | 0.223 | 0.433 | 0.50 | 1.063 | −0.984 | 0.50 |
| −0.324 | 0.836 | 0.50 | 0.382 | 0.219 | 0.50 | 0.752 | −0.672 | 0.50 |
| −0.223 | 0.802 | 0.50 | 0.527 | −0.004 | 0.50 | 0.893 | −0.652 | 0.50 |
| 0.040 | 0.253 | 0.50 | 0.516 | −0.318 | 0.50 | 1.085 | −1.032 | 0.50 |
| −0.173 | 0.412 | 0.50 | 0.081 | 0.591 | 0.50 | 0.663 | −0.232 | 0.50 |
| −0.420 | 0.505 | 0.50 | 0.546 | −0.362 | 0.50 | 0.793 | −0.465 | 0.50 |
| −0.040 | 0.695 | 0.50 | 0.635 | −0.494 | 0.50 | 0.918 | −0.699 | 0.50 |
| −0.376 | 0.847 | 0.50 | 0.189 | 0.474 | 0.50 | 0.927 | −0.940 | 0.50 |
| −0.127 | 0.384 | 0.50 | 0.486 | −0.275 | 0.50 | 1.039 | −0.937 | 0.50 |
| −0.849 | 0.572 | 0.60 | −0.259 | 0.562 | 0.60 | 0.638 | −0.236 | 0.60 |
| −0.603 | 0.635 | 0.60 | −0.056 | 0.411 | 0.60 | 0.406 | 0.159 | 0.60 |

TABLE 1-continued

| X | Y | Z' | X | Y | Z' | X | Y | Z' |
|---|---|---|---|---|---|---|---|---|
| −0.728 | 0.885 | 0.60 | 0.046 | 0.651 | 0.60 | 0.379 | 0.202 | 0.60 |
| −0.530 | 0.929 | 0.60 | −0.146 | 0.817 | 0.60 | 0.237 | 0.413 | 0.60 |
| −0.680 | 0.902 | 0.60 | −0.401 | 0.619 | 0.60 | 0.086 | 0.264 | 0.60 |
| −0.976 | 0.712 | 0.60 | −0.378 | 0.918 | 0.60 | 0.080 | 0.614 | 0.60 |
| −0.898 | 0.559 | 0.60 | −0.305 | 0.585 | 0.60 | 0.245 | 0.066 | 0.60 |
| −0.653 | 0.627 | 0.60 | −0.094 | 0.445 | 0.60 | 0.324 | 0.288 | 0.60 |
| −0.942 | 0.750 | 0.60 | −0.105 | 0.788 | 0.60 | 0.392 | −0.142 | 0.60 |
| −0.949 | 0.556 | 0.60 | −0.329 | 0.906 | 0.60 | 0.532 | −0.355 | 0.60 |
| −0.703 | 0.616 | 0.60 | 0.538 | −0.059 | 0.60 | 0.783 | −0.505 | 0.60 |
| −0.775 | 0.865 | 0.60 | 0.563 | −0.103 | 0.60 | 0.662 | −0.261 | 0.60 |
| −0.904 | 0.784 | 0.60 | 0.266 | 0.372 | 0.60 | 0.640 | −0.527 | 0.60 |
| −0.994 | 0.576 | 0.60 | 0.113 | 0.575 | 0.60 | 0.990 | −1.003 | 0.60 |
| −0.752 | 0.602 | 0.60 | 0.214 | 0.106 | 0.60 | 0.776 | −0.743 | 0.60 |
| −0.501 | 0.636 | 0.60 | 0.363 | −0.100 | 0.60 | 0.923 | −0.776 | 0.60 |
| −0.631 | 0.914 | 0.60 | 0.504 | −0.312 | 0.60 | 0.912 | −0.957 | 0.60 |
| −0.863 | 0.614 | 0.60 | 0.433 | 0.116 | 0.60 | 0.607 | −0.550 | 0.60 |
| −1.016 | 0.620 | 0.60 | 0.295 | 0.330 | 0.60 | 0.721 | −0.657 | 0.60 |
| −0.800 | 0.587 | 0.60 | 0.146 | 0.536 | 0.60 | 0.687 | −0.325 | 0.60 |
| −0.552 | 0.638 | 0.60 | 0.183 | 0.146 | 0.60 | 0.748 | −0.700 | 0.60 |
| −0.581 | 0.924 | 0.60 | 0.334 | −0.058 | 0.60 | 0.946 | −0.822 | 0.60 |
| −0.820 | 0.841 | 0.60 | 0.613 | −0.484 | 0.60 | 0.885 | −0.914 | 0.60 |
| −1.003 | 0.669 | 0.60 | 0.512 | −0.015 | 0.60 | 0.830 | −0.595 | 0.60 |
| −0.352 | 0.604 | 0.60 | 0.588 | −0.147 | 0.60 | 0.711 | −0.370 | 0.60 |
| −0.133 | 0.477 | 0.60 | 0.460 | 0.073 | 0.60 | 0.968 | −0.868 | 0.60 |
| 0.052 | 0.302 | 0.60 | 0.177 | 0.495 | 0.60 | 0.858 | −0.871 | 0.60 |
| −0.065 | 0.756 | 0.60 | 0.151 | 0.186 | 0.60 | 0.854 | −0.640 | 0.60 |
| −0.281 | 0.889 | 0.60 | 0.305 | −0.017 | 0.60 | 0.735 | −0.415 | 0.60 |
| −0.173 | 0.508 | 0.60 | 0.449 | −0.227 | 0.60 | 0.694 | −0.613 | 0.60 |
| 0.017 | 0.339 | 0.60 | 0.586 | −0.441 | 0.60 | 0.991 | −0.913 | 0.60 |
| −0.027 | 0.723 | 0.60 | 0.613 | −0.192 | 0.60 | 0.830 | −0.828 | 0.60 |
| −0.234 | 0.868 | 0.60 | 0.486 | 0.029 | 0.60 | 0.877 | −0.685 | 0.60 |
| −0.479 | 0.930 | 0.60 | 0.352 | 0.245 | 0.60 | 0.990 | −1.003 | 0.60 |
| −0.450 | 0.630 | 0.60 | 0.477 | −0.269 | 0.60 | 0.759 | −0.460 | 0.60 |
| −0.216 | 0.536 | 0.60 | 0.207 | 0.455 | 0.60 | 0.667 | −0.570 | 0.60 |
| −0.019 | 0.375 | 0.60 | 0.119 | 0.225 | 0.60 | 1.011 | −0.960 | 0.60 |
| 0.010 | 0.688 | 0.60 | 0.275 | 0.025 | 0.60 | 0.803 | −0.785 | 0.60 |
| −0.190 | 0.844 | 0.60 | 0.421 | −0.184 | 0.60 | 0.900 | −0.731 | 0.60 |
| −0.429 | 0.926 | 0.60 | 0.559 | −0.398 | 0.60 | 0.943 | −0.998 | 0.60 |
| −0.793 | 0.755 | 0.70 | −0.065 | 0.465 | 0.70 | 0.372 | 0.187 | 0.70 |
| −0.613 | 1.015 | 0.70 | −0.051 | 0.777 | 0.70 | 0.231 | 0.081 | 0.70 |
| −0.844 | 0.948 | 0.70 | −0.241 | 0.928 | 0.70 | 0.244 | 0.393 | 0.70 |
| −0.599 | 0.768 | 0.70 | −0.468 | 1.010 | 0.70 | 0.364 | −0.122 | 0.70 |
| −0.503 | 0.755 | 0.70 | −0.282 | 0.658 | 0.70 | 0.106 | 0.593 | 0.70 |
| −0.841 | 0.748 | 0.70 | −0.098 | 0.500 | 0.70 | 0.544 | −0.411 | 0.70 |
| −0.565 | 1.017 | 0.70 | 0.060 | 0.316 | 0.70 | 0.620 | −0.535 | 0.70 |
| −0.889 | 0.747 | 0.70 | −0.018 | 0.742 | 0.70 | 0.633 | −0.279 | 0.70 |
| −0.801 | 0.970 | 0.70 | −0.200 | 0.902 | 0.70 | 0.517 | −0.066 | 0.70 |
| −0.548 | 0.769 | 0.70 | −0.420 | 1.000 | 0.70 | 0.397 | 0.145 | 0.70 |
| −0.959 | 0.803 | 0.70 | −0.205 | 0.600 | 0.70 | 0.203 | 0.121 | 0.70 |
| −0.516 | 1.015 | 0.70 | −0.323 | 0.684 | 0.70 | 0.270 | 0.352 | 0.70 |
| −0.934 | 0.763 | 0.70 | 0.541 | −0.108 | 0.70 | 0.338 | −0.081 | 0.70 |
| −0.756 | 0.987 | 0.70 | 0.422 | 0.104 | 0.70 | 0.135 | 0.554 | 0.70 |
| −0.696 | 0.766 | 0.70 | 0.175 | 0.160 | 0.70 | 0.467 | −0.287 | 0.70 |
| −0.949 | 0.850 | 0.70 | 0.296 | 0.311 | 0.70 | 0.594 | −0.494 | 0.70 |
| −0.959 | 0.803 | 0.70 | 0.312 | −0.041 | 0.70 | 0.697 | −0.659 | 0.70 |
| −0.709 | 1.000 | 0.70 | 0.163 | 0.514 | 0.70 | 0.826 | −0.864 | 0.70 |
| −0.745 | 0.761 | 0.70 | 0.442 | −0.246 | 0.70 | 0.896 | −0.799 | 0.70 |
| −0.921 | 0.890 | 0.70 | 0.569 | −0.452 | 0.70 | 0.789 | −0.581 | 0.70 |
| −0.661 | 1.010 | 0.70 | 0.564 | −0.151 | 0.70 | 0.678 | −0.365 | 0.70 |
| −0.885 | 0.922 | 0.70 | 0.446 | 0.061 | 0.70 | 0.671 | −0.617 | 0.70 |
| −0.551 | 0.764 | 0.70 | 0.147 | 0.200 | 0.70 | 0.801 | −0.823 | 0.70 |
| −0.132 | 0.535 | 0.70 | 0.322 | 0.270 | 0.70 | 0.917 | −0.842 | 0.70 |
| 0.030 | 0.354 | 0.70 | 0.285 | 0.000 | 0.70 | 0.811 | −0.624 | 0.70 |
| −0.168 | 0.568 | 0.70 | 0.190 | 0.474 | 0.70 | 0.701 | −0.408 | 0.70 |
| 0.015 | 0.706 | 0.70 | 0.416 | −0.204 | 0.70 | 0.645 | −0.576 | 0.70 |
| −0.160 | 0.874 | 0.70 | 0.493 | −0.328 | 0.70 | 0.775 | −0.782 | 0.70 |
| −0.374 | 0.988 | 0.70 | 0.587 | −0.193 | 0.70 | 0.929 | −0.888 | 0.70 |
| −0.366 | 0.706 | 0.70 | 0.470 | 0.019 | 0.70 | 0.832 | −0.668 | 0.70 |
| −0.001 | 0.392 | 0.70 | 0.118 | 0.239 | 0.70 | 0.723 | −0.451 | 0.70 |
| 0.046 | 0.669 | 0.70 | 0.347 | 0.229 | 0.70 | 0.749 | −0.740 | 0.70 |
| −0.123 | 0.843 | 0.70 | 0.258 | 0.040 | 0.70 | 0.897 | −0.921 | 0.70 |
| −0.328 | 0.971 | 0.70 | 0.217 | 0.434 | 0.70 | 0.854 | −0.711 | 0.70 |
| −0.243 | 0.630 | 0.70 | 0.390 | −0.163 | 0.70 | 0.745 | −0.494 | 0.70 |
| −0.033 | 0.429 | 0.70 | 0.076 | 0.631 | 0.70 | 0.723 | −0.700 | 0.70 |
| −0.411 | 0.726 | 0.70 | 0.518 | −0.370 | 0.70 | 0.854 | −0.904 | 0.70 |
| −0.086 | 0.811 | 0.70 | 0.610 | −0.236 | 0.70 | 0.875 | −0.755 | 0.70 |
| −0.284 | 0.951 | 0.70 | 0.494 | −0.023 | 0.70 | 0.767 | −0.537 | 0.70 |

TABLE 1-continued

| X | Y | Z' | X | Y | Z' | X | Y | Z' |
|---|---|---|---|---|---|---|---|---|
| −0.456 | 0.742 | 0.70 | 0.089 | 0.278 | 0.70 | 0.656 | −0.322 | 0.70 |
| −0.713 | 1.119 | 0.80 | −0.186 | 0.641 | 0.80 | 0.199 | 0.111 | 0.80 |
| −0.888 | 0.951 | 0.80 | −0.361 | 0.796 | 0.80 | 0.255 | 0.356 | 0.80 |
| −0.758 | 1.109 | 0.80 | −0.392 | 1.075 | 0.80 | 0.371 | 0.154 | 0.80 |
| −0.526 | 1.116 | 0.80 | −0.194 | 0.952 | 0.80 | 0.273 | −0.008 | 0.80 |
| −0.711 | 0.914 | 0.80 | −0.032 | 0.784 | 0.80 | 0.148 | 0.190 | 0.80 |
| −0.618 | 0.905 | 0.80 | −0.010 | 0.423 | 0.80 | 0.483 | −0.052 | 0.80 |
| −0.850 | 0.925 | 0.80 | −0.154 | 0.606 | 0.80 | 0.592 | −0.259 | 0.80 |
| −0.802 | 1.093 | 0.80 | −0.323 | 0.768 | 0.80 | 0.613 | −0.568 | 0.80 |
| −0.573 | 1.123 | 0.80 | 0.025 | 0.710 | 0.80 | 0.491 | −0.368 | 0.80 |
| −0.572 | 0.895 | 0.80 | −0.436 | 1.092 | 0.80 | 0.371 | −0.168 | 0.80 |
| −0.804 | 0.918 | 0.80 | −0.231 | 0.981 | 0.80 | 0.123 | 0.230 | 0.80 |
| −0.843 | 1.010 | 0.80 | −0.062 | 0.820 | 0.80 | 0.106 | 0.595 | 0.80 |
| −0.619 | 1.126 | 0.80 | 0.206 | 0.437 | 0.80 | 0.231 | 0.397 | 0.80 |
| −0.527 | 0.881 | 0.80 | 0.325 | 0.235 | 0.80 | 0.322 | −0.088 | 0.80 |
| −0.757 | 0.916 | 0.80 | 0.097 | 0.269 | 0.80 | 0.348 | 0.194 | 0.80 |
| −0.877 | 1.038 | 0.80 | 0.439 | 0.031 | 0.80 | 0.461 | −0.011 | 0.80 |
| −0.664 | 0.911 | 0.80 | 0.549 | −0.176 | 0.80 | 0.571 | −0.218 | 0.80 |
| −0.666 | 1.125 | 0.80 | 0.539 | −0.449 | 0.80 | 0.249 | 0.032 | 0.80 |
| −0.897 | 0.996 | 0.80 | 0.419 | −0.248 | 0.80 | 0.637 | −0.608 | 0.80 |
| 0.053 | 0.672 | 0.80 | 0.298 | −0.048 | 0.80 | 0.515 | −0.409 | 0.80 |
| 0.018 | 0.385 | 0.80 | 0.182 | 0.476 | 0.80 | 0.395 | −0.208 | 0.80 |
| −0.124 | 0.571 | 0.80 | 0.302 | 0.276 | 0.80 | 0.656 | −0.384 | 0.80 |
| −0.287 | 0.739 | 0.80 | 0.417 | 0.072 | 0.80 | 0.759 | −0.594 | 0.80 |
| −0.483 | 0.864 | 0.80 | 0.224 | 0.072 | 0.80 | 0.662 | −0.648 | 0.80 |
| −0.481 | 1.105 | 0.80 | 0.527 | −0.135 | 0.80 | 0.856 | −0.807 | 0.80 |
| −0.269 | 1.008 | 0.80 | 0.635 | −0.343 | 0.80 | 0.835 | −0.846 | 0.80 |
| −0.093 | 0.855 | 0.80 | 0.174 | 0.151 | 0.80 | 0.739 | −0.552 | 0.80 |
| 0.045 | 0.346 | 0.80 | 0.564 | −0.489 | 0.80 | 0.687 | −0.687 | 0.80 |
| −0.094 | 0.534 | 0.80 | 0.443 | −0.288 | 0.80 | 0.840 | −0.764 | 0.80 |
| −0.252 | 0.708 | 0.80 | 0.071 | 0.307 | 0.80 | 0.719 | −0.510 | 0.80 |
| −0.441 | 0.844 | 0.80 | 0.157 | 0.516 | 0.80 | 0.712 | −0.727 | 0.80 |
| −0.309 | 1.033 | 0.80 | 0.278 | 0.316 | 0.80 | 0.820 | −0.721 | 0.80 |
| −0.125 | 0.889 | 0.80 | 0.394 | 0.113 | 0.80 | 0.698 | −0.468 | 0.80 |
| −0.066 | 0.498 | 0.80 | 0.080 | 0.633 | 0.80 | 0.736 | −0.767 | 0.80 |
| −0.159 | 0.921 | 0.80 | 0.505 | −0.093 | 0.80 | 0.800 | −0.679 | 0.80 |
| −0.218 | 0.675 | 0.80 | 0.614 | −0.301 | 0.80 | 0.791 | −0.843 | 0.80 |
| −0.400 | 0.821 | 0.80 | 0.588 | −0.529 | 0.80 | 0.677 | −0.426 | 0.80 |
| −0.350 | 1.055 | 0.80 | 0.467 | −0.328 | 0.80 | 0.761 | −0.807 | 0.80 |
| −0.003 | 0.747 | 0.80 | 0.346 | −0.128 | 0.80 | 0.780 | −0.637 | 0.80 |
| −0.037 | 0.460 | 0.80 | 0.132 | 0.555 | 0.80 | 0.835 | −0.846 | 0.80 |
| −0.508 | 1.226 | 0.90 | 0.022 | 0.358 | 0.90 | 0.604 | −0.336 | 0.90 |
| −0.705 | 1.070 | 0.90 | −0.068 | 0.845 | 0.90 | 0.504 | −0.133 | 0.90 |
| −0.730 | 1.251 | 0.90 | −0.215 | 1.017 | 0.90 | 0.401 | 0.069 | 0.90 |
| −0.498 | 0.981 | 0.90 | −0.388 | 1.164 | 0.90 | 0.294 | 0.269 | 0.90 |
| −0.749 | 1.080 | 0.90 | −0.425 | 0.927 | 0.90 | 0.142 | 0.166 | 0.90 |
| −0.685 | 1.257 | 0.90 | −0.267 | 0.764 | 0.90 | 0.181 | 0.466 | 0.90 |
| −0.536 | 1.005 | 0.90 | −0.129 | 0.584 | 0.90 | 0.259 | −0.028 | 0.90 |
| −0.792 | 1.093 | 0.90 | −0.003 | 0.396 | 0.90 | 0.062 | 0.659 | 0.90 |
| −0.640 | 1.257 | 0.90 | −0.041 | 0.808 | 0.90 | 0.376 | −0.223 | 0.90 |
| −0.576 | 1.026 | 0.90 | −0.184 | 0.984 | 0.90 | 0.493 | −0.417 | 0.90 |
| −0.830 | 1.168 | 0.90 | −0.350 | 1.138 | 0.90 | 0.614 | −0.609 | 0.90 |
| −0.825 | 1.124 | 0.90 | −0.461 | 0.955 | 0.90 | 0.624 | −0.377 | 0.90 |
| −0.595 | 1.252 | 0.90 | −0.297 | 0.798 | 0.90 | 0.524 | −0.173 | 0.90 |
| −0.618 | 1.043 | 0.90 | −0.156 | 0.621 | 0.90 | 0.422 | 0.029 | 0.90 |
| −0.808 | 1.207 | 0.90 | −0.028 | 0.434 | 0.90 | 0.315 | 0.229 | 0.90 |
| −0.830 | 1.168 | 0.90 | 0.213 | 0.049 | 0.90 | 0.116 | 0.204 | 0.90 |
| −0.551 | 1.241 | 0.90 | 0.111 | 0.582 | 0.90 | 0.204 | 0.427 | 0.90 |
| −0.661 | 1.058 | 0.90 | 0.329 | −0.145 | 0.90 | 0.236 | 0.010 | 0.90 |
| −0.772 | 1.234 | 0.90 | 0.446 | −0.339 | 0.90 | 0.086 | 0.621 | 0.90 |
| −0.015 | 0.771 | 0.90 | 0.565 | −0.533 | 0.90 | 0.353 | −0.184 | 0.90 |
| −0.154 | 0.951 | 0.90 | 0.565 | −0.255 | 0.90 | 0.470 | −0.378 | 0.90 |
| −0.315 | 1.110 | 0.90 | 0.463 | −0.052 | 0.90 | 0.590 | −0.571 | 0.90 |
| −0.327 | 0.832 | 0.90 | 0.358 | 0.149 | 0.90 | 0.544 | −0.214 | 0.90 |
| −0.183 | 0.658 | 0.90 | 0.070 | 0.281 | 0.90 | 0.442 | −0.012 | 0.90 |
| −0.052 | 0.472 | 0.90 | 0.249 | 0.348 | 0.90 | 0.337 | 0.189 | 0.90 |
| 0.011 | 0.734 | 0.90 | 0.189 | 0.088 | 0.90 | 0.094 | 0.243 | 0.90 |
| −0.124 | 0.916 | 0.90 | 0.134 | 0.544 | 0.90 | 0.227 | 0.388 | 0.90 |
| −0.280 | 1.080 | 0.90 | 0.306 | −0.106 | 0.90 | 0.686 | −0.724 | 0.90 |
| −0.466 | 1.208 | 0.90 | 0.423 | −0.301 | 0.90 | 0.759 | −0.664 | 0.90 |
| −0.359 | 0.865 | 0.90 | 0.541 | −0.494 | 0.90 | 0.663 | −0.459 | 0.90 |
| −0.210 | 0.694 | 0.90 | 0.585 | −0.295 | 0.90 | 0.662 | −0.686 | 0.90 |
| −0.078 | 0.510 | 0.90 | 0.483 | −0.092 | 0.90 | 0.777 | −0.706 | 0.90 |
| 0.046 | 0.320 | 0.90 | 0.380 | 0.109 | 0.90 | 0.682 | −0.500 | 0.90 |
| 0.037 | 0.697 | 0.90 | 0.272 | 0.309 | 0.90 | 0.765 | −0.749 | 0.90 |
| −0.096 | 0.881 | 0.90 | 0.165 | 0.127 | 0.90 | 0.701 | −0.541 | 0.90 |
| −0.247 | 1.049 | 0.90 | 0.158 | 0.505 | 0.90 | 0.752 | −0.778 | 0.90 |

TABLE 1-continued

| X | Y | Z' | X | Y | Z' | X | Y | Z' |
|---|---|---|---|---|---|---|---|---|
| −0.426 | 1.187 | 0.90 | 0.283 | −0.067 | 0.90 | 0.720 | −0.582 | 0.90 |
| −0.391 | 0.896 | 0.90 | 0.399 | −0.262 | 0.90 | 0.713 | −0.761 | 0.90 |
| −0.238 | 0.729 | 0.90 | 0.517 | −0.456 | 0.90 | 0.740 | −0.623 | 0.90 |
| −0.103 | 0.547 | 0.90 | 0.638 | −0.647 | 0.90 | 0.644 | −0.418 | 0.90 |
| −0.815 | 1.203 | 0.92 | 0.308 | −0.119 | 0.92 | 0.367 | 0.129 | 0.92 |
| −0.812 | 1.158 | 0.92 | 0.331 | −0.157 | 0.92 | 0.346 | 0.168 | 0.92 |
| −0.783 | 1.126 | 0.92 | 0.354 | −0.196 | 0.92 | 0.325 | 0.208 | 0.92 |
| −0.740 | 1.112 | 0.92 | 0.377 | −0.234 | 0.92 | 0.304 | 0.247 | 0.92 |
| −0.697 | 1.100 | 0.92 | 0.400 | −0.273 | 0.92 | 0.282 | 0.287 | 0.92 |
| −0.655 | 1.086 | 0.92 | 0.424 | −0.311 | 0.92 | 0.260 | 0.326 | 0.92 |
| −0.613 | 1.070 | 0.92 | 0.447 | −0.349 | 0.92 | 0.239 | 0.365 | 0.92 |
| −0.573 | 1.050 | 0.92 | 0.470 | −0.387 | 0.92 | 0.216 | 0.404 | 0.92 |
| −0.534 | 1.028 | 0.92 | 0.494 | −0.425 | 0.92 | 0.194 | 0.442 | 0.92 |
| −0.497 | 1.003 | 0.92 | 0.517 | −0.463 | 0.92 | 0.171 | 0.481 | 0.92 |
| −0.462 | 0.975 | 0.92 | 0.541 | −0.501 | 0.92 | 0.148 | 0.519 | 0.92 |
| −0.428 | 0.946 | 0.92 | 0.565 | −0.539 | 0.92 | 0.125 | 0.558 | 0.92 |
| −0.396 | 0.915 | 0.92 | 0.589 | −0.577 | 0.92 | 0.101 | 0.596 | 0.92 |
| −0.365 | 0.883 | 0.92 | 0.613 | −0.614 | 0.92 | 0.077 | 0.633 | 0.92 |
| −0.335 | 0.849 | 0.92 | 0.637 | −0.652 | 0.92 | 0.053 | 0.671 | 0.92 |
| −0.305 | 0.815 | 0.92 | 0.661 | −0.690 | 0.92 | 0.028 | 0.708 | 0.92 |
| −0.277 | 0.781 | 0.92 | 0.685 | −0.728 | 0.92 | 0.003 | 0.745 | 0.92 |
| −0.249 | 0.746 | 0.92 | 0.715 | −0.761 | 0.92 | −0.022 | 0.782 | 0.92 |
| −0.222 | 0.710 | 0.92 | 0.757 | −0.757 | 0.92 | −0.048 | 0.819 | 0.92 |
| −0.195 | 0.674 | 0.92 | 0.774 | −0.718 | 0.92 | −0.075 | 0.855 | 0.92 |
| −0.169 | 0.638 | 0.92 | 0.758 | −0.676 | 0.92 | −0.102 | 0.891 | 0.92 |
| −0.143 | 0.602 | 0.92 | 0.739 | −0.636 | 0.92 | −0.129 | 0.926 | 0.92 |
| −0.118 | 0.565 | 0.92 | 0.720 | −0.595 | 0.92 | −0.157 | 0.961 | 0.92 |
| −0.093 | 0.528 | 0.92 | 0.701 | −0.554 | 0.92 | −0.186 | 0.995 | 0.92 |
| −0.068 | 0.490 | 0.92 | 0.683 | −0.514 | 0.92 | −0.216 | 1.026 | 0.92 |
| −0.044 | 0.453 | 0.92 | 0.664 | −0.473 | 0.92 | −0.247 | 1.061 | 0.92 |
| −0.019 | 0.415 | 0.92 | 0.645 | −0.433 | 0.92 | −0.278 | 1.092 | 0.92 |
| 0.005 | 0.377 | 0.92 | 0.626 | −0.392 | 0.92 | −0.311 | 1.123 | 0.92 |
| 0.029 | 0.340 | 0.92 | 0.607 | −0.352 | 0.92 | −0.345 | 1.152 | 0.92 |
| 0.052 | 0.302 | 0.92 | 0.587 | −0.311 | 0.92 | −0.380 | 1.179 | 0.92 |
| 0.076 | 0.264 | 0.92 | 0.568 | −0.271 | 0.92 | −0.417 | 1.204 | 0.92 |
| 0.099 | 0.226 | 0.92 | 0.548 | −0.231 | 0.92 | −0.456 | 1.227 | 0.92 |
| 0.123 | 0.187 | 0.92 | 0.529 | −0.191 | 0.92 | −0.496 | 1.247 | 0.92 |
| 0.146 | 0.149 | 0.92 | 0.509 | −0.151 | 0.92 | −0.538 | 1.263 | 0.92 |
| 0.169 | 0.111 | 0.92 | 0.489 | −0.110 | 0.92 | −0.581 | 1.276 | 0.92 |
| 0.193 | 0.073 | 0.92 | 0.469 | −0.070 | 0.92 | −0.625 | 1.284 | 0.92 |
| 0.216 | 0.034 | 0.92 | 0.449 | −0.030 | 0.92 | −0.669 | 1.286 | 0.92 |
| 0.239 | −0.004 | 0.92 | 0.428 | 0.010 | 0.92 | −0.714 | 1.281 | 0.92 |
| 0.262 | −0.042 | 0.92 | 0.408 | 0.049 | 0.92 | −0.756 | 1.266 | 0.92 |
| 0.285 | −0.081 | 0.92 | 0.387 | 0.099 | 0.92 | −0.792 | 1.240 | 0.92 |

In this preferred embodiment of a second stage turbine bucket, there are ninety-two (92) bucket airfoils which are air-cooled. For reference purposes, there is established a datum U passing through the shank portion of the bucket, as illustrated in FIG. 5. In the preferred embodiment of the second stage bucket hereof, the datum U is 24.100 inches from the engine or rotor centerline. The bucket radial height is 11.280 inches from the datum to the cutter tooth 40 on the tip shroud 42. Consequently, the bucket radial height from the engine centerline is 35.380 inches. The airfoil sections start at Z=0% span, which is 2.221 inch from datum U (26.321 inches from the engine centerline). The airfoil sections end at Z=100% span, which is 11.122 inches from datum U (35.222 inches from the engine centerline). With respect to the non-dimensionalized value Z in Table 1, Z=0.088 or 8.8% span, corresponding to 3.005 inches from datum U (27.105 inches from the engine centerline). The Z value of Table 1 at 0.92 or 92% span corresponds to a distance of 10.410 inches from datum U (34.510 inches from the engine centerline). While not forming part of the present invention, each second stage bucket airfoil 36 includes a plurality of internal air-cooling passages, not shown, which exhaust cooling air into the hot gas path adjacent the tip shroud 42.

It will also be appreciated that the airfoil disclosed in the above Table may be scaled up or down geometrically for use in other similar turbine designs. Consequently, the coordinate values set forth in Table 1 may be scaled upwardly or downwardly such that the airfoil profile shape remains unchanged. The X and Y coordinate values of Table 1 multiplied or divided by a constant number would represent a scaled version.

To scale the bucket airfoil in the Z direction, the constant must also be applied to the 0% and 100% radial spans given in Table 1.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket including a bucket airfoil having an airfoil shape, the airfoil having a nominal profile substantially in accordance with Cartesian coordinate values of X, Y and Z set forth in Table 1 wherein the Z values are non-dimensional values from 0.088 to 0.92 convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape.

2. A turbine bucket according to claim 1 forming part of a second stage of a turbine.

3. A turbine bucket according to claim 1 wherein said airfoil shape lies in an envelope within ±0.160 inches in a direction normal to any airfoil surface location.

4. A turbine bucket according to claim 1 wherein the height of the turbine airfoil from Z=8.8% span to Z=92% span is 7.405 inches.

5. A turbine bucket including a bucket airfoil having an uncoated nominal airfoil profile substantially in accordance with Cartesian coordinate values of X, Y and Z set forth in Table 1 wherein the Z values are non-dimensional values from 0.088 to 0.92 convertible to Z distances in inches by multiplying the Z values by a height of the airfoil in inches, and wherein X and Y are distances in inches which, when connected by smooth continuing arcs, define airfoil profile sections at each Z distance, the profile sections at the Z distances being joined smoothly with one another to form a complete airfoil shape, the X and Y distances being scalable as a function of the same constant or number to provide a scaled-up or scaled-down airfoil.

6. A turbine bucket according to claim 5 forming part of a second stage of a turbine.

7. A turbine bucket according to claim 5 wherein said airfoil shape lies in an envelope within ±0.160 inches in a direction normal to any airfoil surface location.

8. A turbine bucket according to claim 5 wherein the height of the turbine airfoil from Z=8.8% span to Z=92% span is 7.405 inches.

9. A turbine comprising a turbine wheel having a plurality of buckets, each of said buckets including an airfoil having an airfoil shape, said airfoil having a nominal profile substantially in accordance with Cartesian coordinate values of X, Y and Z set forth in Table 1 wherein the Z values are non-dimensional values from 0.088 to 0.92 convertible to Z distances in inches by multiplying the Z values by a height of the airfoil in inches, and wherein X and Y are distances in inches which, when connected by smooth continuing arcs, define the airfoil profile sections at each distance Z, the profile sections at the Z distances being joined smoothly with one another to form a complete airfoil shape.

10. A turbine according to claim 9 wherein the turbine wheel comprises a second stage of the turbine.

11. A turbine according to claim 9 wherein the turbine wheel has 92 buckets and X represents a distance parallel to the turbine axis of rotation.

12. A turbine according to claim 9 wherein the height of the turbine airfoil from Z=8.8% span to Z=92% span is 7.405 inches.

13. A turbine according to claim 9 wherein the radial distance from an axial centerline of the turbine wheel to the Z value at 8.8% of span is 27.105 inches.

14. A turbine according to claim 13 wherein the radial distance from the axial centerline of the turbine wheel to the Z value at 92% of span is 34.510 inches.

15. A turbine comprising a turbine wheel having a plurality of buckets, each of said buckets including an airfoil having an uncoated nominal airfoil profile substantially in accordance with Cartesian coordinate values of X, Y and Z set forth in Table 1 wherein the Z values are non-dimensional values from 0.088 to 0.92 convertible to Z distances in inches by multiplying the Z values by a height of the airfoil in inches, and wherein X and Y are distances in inches which, when connected by smooth continuing arcs, define airfoil profile sections at each distance Z, the profile sections at the Z distances being joined smoothly with one another to form a complete airfoil shape, the X and Y distances being scalable as a function of the same constant or number to provide a scaled-up or scaled-down bucket airfoil.

16. A turbine according to claim 15 wherein the turbine wheel comprises a second stage of the turbine.

17. A turbine according to claim 15 wherein the turbine wheel has 92 buckets and X represents a distance parallel to the turbine axis of rotation.

18. A turbine according to claim 15 wherein the height of the turbine airfoil from Z=8.8% span to Z=92% span is 7.405 inches.

19. A turbine according to claim 15 wherein the radial distance from an axial centerline of the turbine wheel to the Z value at 8.8% of span is 27.105 inches.

20. A turbine according to claim 19 wherein the wherein the radial distance from the axial centerline of the turbine wheel to the Z value at 92% of span is 34.510 inches.

21. A turbine according to claim 15 wherein said airfoil shape lies in an envelope within ±0.16.0. inches in a direction normal to any airfoil surface location.

* * * * *